US011855350B2

(12) United States Patent
Van Wonterghem et al.

(10) Patent No.: US 11,855,350 B2
(45) Date of Patent: Dec. 26, 2023

(54) MILLIMETER-WAVE ASSEMBLY

(71) Applicant: Huawei Technologies Co., Ltd., Shenzhen (CN)

(72) Inventors: Jari Kristian Van Wonterghem, Kista (SE); Alexander Khripkov, Helsinki (FI); Dong Liu, Dongguan (CN); Janne Ilvonen, Helsinki (FI); Jian Ou, Kista (SE); Ruiyuan Tian, Helsinki (FI); Changnian Xu, Shenzhen (CN); Wei Huang, Shenzhen (CN); Zlatoljub Milosavljevic, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 141 days.

(21) Appl. No.: 17/678,695

(22) Filed: Feb. 23, 2022

(65) Prior Publication Data

US 2022/0255237 A1 Aug. 11, 2022

Related U.S. Application Data

(63) Continuation of application No. 17/237,845, filed on Apr. 22, 2021, now Pat. No. 11,296,422, which is a continuation of application No. PCT/EP2019/055249, filed on Mar. 4, 2019.

(51) Int. Cl.
*H01Q 1/24* (2006.01)
*H01Q 21/00* (2006.01)

(52) U.S. Cl.
CPC ..... *H01Q 21/0025* (2013.01); *H01Q 1/24* (2013.01); *H01Q 21/00* (2013.01)

(58) Field of Classification Search
CPC ..... H01Q 21/0025; H01Q 21/00; H01Q 1/24
USPC ..... 343/893
See application file for complete search history.

(56) References Cited

U.S. PATENT DOCUMENTS

| | | | |
|---|---|---|---|
| 5,907,817 | A | 5/1999 | Mendolia |
| 2002/0158722 | A1 | 10/2002 | Maruhashi et al. |
| 2005/0200533 | A1 | 9/2005 | Brown et al. |
| 2006/0049988 | A1 | 3/2006 | Kim et al. |
| 2010/0240327 | A1 | 9/2010 | Lambrecht et al. |
| 2012/0235881 | A1 | 9/2012 | Pan et al. |

(Continued)

FOREIGN PATENT DOCUMENTS

| | | | |
|---|---|---|---|
| CN | 101809814 | A | 8/2010 |
| CN | 103457015 | A | 12/2013 |

(Continued)

*Primary Examiner* — Hai V Tran
(74) *Attorney, Agent, or Firm* — Conley Rose, P.C.

(57) ABSTRACT

A millimeter-wave (mmWave) assembly (1) comprising a first mmWave module (2), a second mmWave module (3), and a connector (4) configured to releasably interconnect the first mmWave module (2) and the second mmWave module (3). The connector (4) comprises a first connector element (5) associated with the first mmWave module (2). The first mmWave module (2) comprises a first substrate (7) and an mmWave radio frequency integrated circuit (RFIC) (8), and the second mmWave module (3) comprises a second substrate (9) and an mmWave antenna array (10). The connector (4) is configured to transmit at least one signal between the mmWave RFIC (8) and the mmWave antenna array (10) when the first mmWave module (2) and the second mmWave module (3) are interconnected.

20 Claims, 4 Drawing Sheets

(56) References Cited

U.S. PATENT DOCUMENTS

| | | | | |
|---|---|---|---|---|
| 2014/0106684 | A1 | 4/2014 | Burns et al. | |
| 2015/0070228 | A1 | 3/2015 | Gu et al. | |
| 2015/0255856 | A1 | 9/2015 | Hong et al. | |
| 2016/0056544 | A1 | 2/2016 | Garcia et al. | |
| 2018/0026341 | A1 | 1/2018 | Mow et al. | |
| 2018/0248254 | A1 | 8/2018 | Islam et al. | |
| 2019/0036207 | A1 | 1/2019 | Kim et al. | |
| 2019/0058264 | A1 | 2/2019 | Jung et al. | |
| 2019/0207323 | A1 | 7/2019 | Joung et al. | |
| 2019/0372229 | A1* | 12/2019 | Dalmia | H01Q 3/01 |
| 2020/0091581 | A1* | 3/2020 | Ou | H01Q 21/065 |
| 2020/0112081 | A1 | 4/2020 | Kim et al. | |
| 2020/0127361 | A1* | 4/2020 | Lee | H05K 1/0203 |
| 2020/0303808 | A1* | 9/2020 | Jeon | H01Q 9/16 |

FOREIGN PATENT DOCUMENTS

| | | | |
|---|---|---|---|
| CN | 103811877 | A | 5/2014 |
| CN | 109309277 | A | 2/2019 |
| CN | 110021815 | A | 7/2019 |
| CN | 110312009 | A | 10/2019 |
| EP | 3444894 | A1 | 2/2019 |
| KR | 20060022016 | A | 3/2006 |
| KR | 20100061499 | A | 6/2010 |
| KR | 20190019802 | A | 2/2019 |
| WO | 2009029520 | A1 | 3/2009 |
| WO | 2019120519 | A1 | 6/2019 |
| WO | 2020177846 | A1 | 9/2020 |

* cited by examiner

MILLIMETER-WAVE ASSEMBLY

CROSS-REFERENCE TO RELATED APPLICATIONS

This application is a continuation of U.S. patent application Ser. No. 17/237,845, filed on Apr. 22, 2021, which is a continuation of International Application No. PCT/EP2019/055249, filed on Mar. 4, 2019. All of the afore-mentioned patent applications are hereby incorporated by reference in their entireties.

TECHNICAL FIELD

The disclosure relates to a millimeter-wave (mmWave) assembly comprising a first mmWave module, a second mmWave module, and a connector configured to interconnect the first mmWave module and the second mmWave module.

BACKGROUND

Electronic devices need to support more and more radio signal technology such as $2^{nd}$ generation/$3^{rd}$ generation/$4^{th}$ generation (2G/3G/4G) radio. For coming $5^{th}$ generation (5G) radio technology, the frequency range will be expanded from sub-6 gigahertz (GHz) to so called millimeter-wave (mmWave) frequency, e.g., above 20 GHz. For mmWave frequencies, an antenna array will be necessary in order to form a radiation beam with higher gain which overcomes the higher path loss in the propagation media. However, radiation beam patterns with higher gain result in a narrow beam width, wherefore beam steering techniques such as the phased antenna array is used to steer the beam in a specific, desired direction.

Mobile electronic devices, such as mobile phones and tablets, may be oriented in any arbitrary direction. Therefore, such electronic devices need to exhibit an as near full spherical beam coverage as possible. Such coverage is difficult to achieve, i.e., due to the radiation beam being blocked by a conductive housing, a large display, and/or by the hand of the user holding the device.

Conventionally, an mmWave antenna array is arranged next to the display, such that the display does not interfere with the beam coverage. However, the movement towards very large displays, covering as much as possible of the electronic device, makes the space available for the antenna array very limited, forcing either the size of the antenna array to be significantly reduced, and its performance impaired, or a large part of the display to be inactive.

The limited antenna space makes implementing an mmWave antenna array, while getting sufficient beam coverage, difficult. There is not enough space on the display side for a conventional mmWave antenna array in the same module together with the radio-frequency (RF) active circuit circuitry. One solution to this problem is to implement a distributed antenna array, where the mmWave antenna array is arranged in a mechanically separate part other than the RF active circuit circuitry. This allows placing the mmWave antenna within the display clearance while allowing the RF active circuit to be located further away, where there is space.

SUMMARY

It is an object to provide an improved mmWave assembly. The foregoing and other objects are achieved by the features of the independent claims. Further implementation forms are apparent from the dependent claims, the description, and the figures.

According to a first aspect, there is provided an mmWave assembly comprising a first mmWave module, a second mmWave module, and a connector configured to releasably interconnect the first mmWave module and the second mmWave module, the connector comprising a first connector element, associated with the first mmWave module, the first mmWave module comprising a first substrate and an mmWave RF integrated circuit (RFIC), the second mmWave module comprising a second substrate and an mmWave antenna array, the connector being configured to transmit at least one signal between the mmWave RFIC and the mmWave antenna array when the first mmWave module and the second mmWave module are interconnected.

Such a solution allows an mmWave assembly which has a small footprint while still having sufficient radiofrequency performance. Furthermore, the mmWave assembly facilitates assembly and repair, by dividing the assembly into at least two, repeatedly attachable and detachable, parts. Additionally, the detachability allows the mmWave assembly to use any available space within, e.g., an electronic device.

In a possible implementation form of the first aspect, the connector further comprises a second connector element associated with the second mmWave module, allowing a range of suitable interconnecting elements to be used.

In a further possible implementation form of the first aspect, the mmWave antenna array comprises at least one mmWave antenna, and the connector is configured to transmit the signal between the mmWave RFIC and the mmWave antenna(s), facilitating sufficient signal strength and directional coverage.

In a further possible implementation form of the first aspect, the first connector element engages directly with the second substrate or the second connector element, allowing an interconnection which comprises few parts and which is easy to assemble and manufacture.

In a further possible implementation form of the first aspect, the connector comprises a third connector element, with the first connector element and the second connector element engaging through the third connector element, allowing interconnecting sections to be arranged on a separate element.

In a further possible implementation form of the first aspect, the third connector element comprises a first section and a second section, with the first section engaging the first connector element and the second section engaging the second connector element, thus facilitating a third connector element having as small footprint as possible.

In a further possible implementation form of the first aspect, the connector transmits the signal by means of engagement between at least one of the first connector element and the second substrate, the first connector element and the second connector element, the first section of the third connector element and the first connector element, and the second section of the third connector element and the second connector element, facilitating signal transmission between the first substrate and a plurality of antenna arrays.

In a further possible implementation form of the first aspect, the engagement comprises a galvanic connection facilitating a direct current flow.

In a further possible implementation form of the first aspect, the engagement comprises a non-galvanic connection provided by means of inductive or capacitive near field coupling between at least two of the first connector element, the second connector element, and the third connector element, facilitating isolation of selected components by preventing direct current flow between these components.

In a further possible implementation form of the first aspect, at least one of the first connector element, the second connector element, or the third connector element comprises a coplanar structure, allowing an mmWave assembly which has a small footprint and the shape of which can be adapted to space available, as well as allowing interconnection of one or more mmWave antenna arrays to the first substrate.

In a further possible implementation form of the first aspect, at least one of the first connector element, the second connector element, or the third connector element comprises a spring structure, allowing the mmWave assembly to be at least partially flexible which facilitates assembly and reduces the tolerances needed.

In a further possible implementation form of the first aspect, the first mmWave module comprises a further mmWave antenna array, the further mmWave antenna array comprising at least one mmWave antenna, facilitating increased signal strength and directional coverage.

In a further possible implementation form of the first aspect, at least one of the first substrate or the second substrate is a flexible or rigid printed circuit board, thereby reducing the need for additional antenna components.

In a further possible implementation form of the first aspect, the mmWave antenna array is offset in at least one direction in relation to a main plane of the first substrate, allowing the first substrate and the mmWave antenna array to be placed independently of each other, in locations where more space is available.

In a further possible implementation form of the first aspect, the mmWave antenna array extends at an angle ≥0° to a main plane of the first substrate, allowing the mmWave antenna array to be placed on a side of a device, which e.g., is opposite to that where the radiofrequency circuitry and printed circuit board (PCB) is located, extending the coverage to the display side of the device.

According to a second aspect, there is provided an electronic device comprising a device chassis, an mmWave assembly according to the above, and a housing enclosing the device chassis and the mmWave assembly, the first mmWave module of the mmWave assembly being connected to the device chassis. This solution allows an mmWave assembly which has a small footprint while still having sufficient radiofrequency performance. Furthermore, the mmWave assembly facilitates assembly and repair, by dividing the assembly into at least two, repeatedly attachable and detachable, parts. Additionally, the detachability allows the mmWave assembly to use any available space within the electronic device.

In a possible implementation form of the second aspect, the mmWave assembly comprises at least one mmWave antenna array, each mmWave antenna array extending adjacent a face of the housing, and facilitating sufficient signal strength and directional coverage.

According to a third aspect, there is provided a method of assembling the electronic device according to the above, comprising the sequential or nonsequential steps of connecting the first mmWave module of the mmWave assembly to the device chassis, connecting the second mmWave module of the mmWave assembly to the device chassis, the housing, and/or an electromechanical module arranged between the device chassis and the housing, engaging the first mmWave module with the second mmWave module by means of a connector comprising at least a first connector element, associated with the first mmWave module. Such a method allows an mmWave assembly which has a small footprint while still having sufficient radiofrequency performance. Furthermore, the method facilitates assembly and repair, by dividing the assembly into at least two, repeatedly attachable and detachable, parts. Additionally, the detachability allows the mmWave assembly to use any available space within, e.g., an electronic device.

In a possible implementation form of the third aspect, the connector further comprises a second connector element associated with the second mmWave module, with the first mmWave module engaging with the second mmWave module by means of the first connector element engaging with the second connector element, thus allowing a range of suitable interconnecting elements to be used.

In a further possible implementation form of the third aspect, the first mmWave module engages with the second mmWave module by means of a third connector element, with a first section of the third connector element engaging the first connector element and second section of the third connector element engaging the second connector element, thus allowing interconnecting sections to be arranged on a separate element.

This and other aspects will be apparent from the embodiments described below.

BRIEF DESCRIPTION OF THE DRAWINGS

In the following detailed portion of the present disclosure, the aspects, embodiments and implementations will be explained in more detail with reference to the example embodiments shown in the drawings, in which.

DETAILED DESCRIPTION

Figure 1:
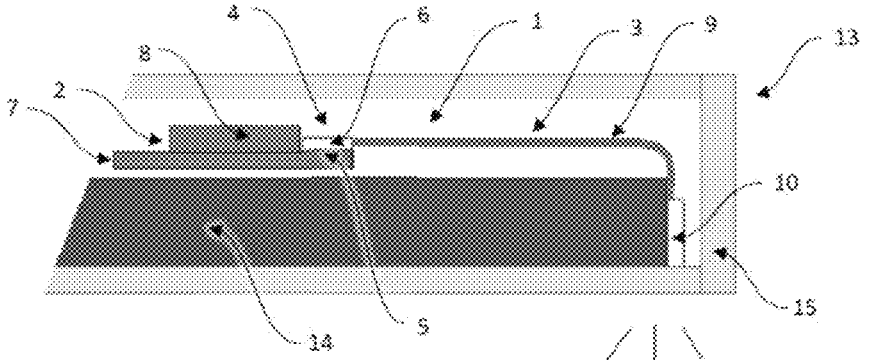
FIG. 1 shows a schematic cross-sectional side view of a millimeter-wave assembly mounted in an electronic device in accordance with one embodiment of the present disclosure.

FIGS. 1 to 7B show an electronic device 13 comprising a device chassis 14, a millimeter-Wave (mmWave) assembly 1, described in more detail further below, and a housing 15 enclosing the device chassis 14 and the mmWave assembly 1. The mmWave assembly 1 comprises at least a first mmWave module 2, a second mmWave module 3, and a connector 4 configured to releasably interconnect the first mmWave module 2 and the second mmWave module 3.

The first mmWave module 2 of the mmWave assembly 1 may be connected to the device chassis 14, or an internal component of the electronic device 13 such as a flexible or rigid printed circuit board (PCB). The flexible PCB may be a liquid crystal polymer (LCP) PCB.

In one embodiment, the mmWave assembly 1 comprises at least one mmWave antenna array 10, 12, with each mmWave antenna array 10, 12 extending adjacent a face of the housing 15.

Figure 7A:
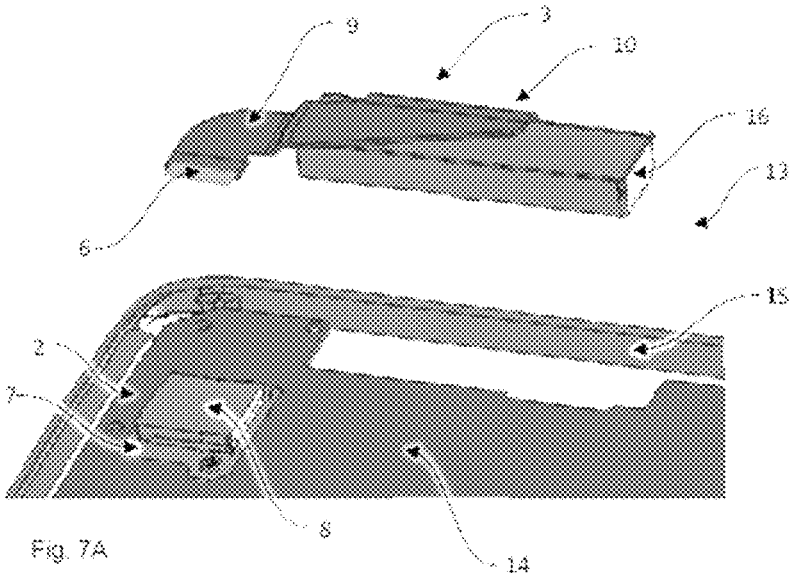
FIG. 7A shows a perspective view of a millimeter-wave assembly and an electronic device in accordance with one embodiment of the present disclosure.
Figure 7B:
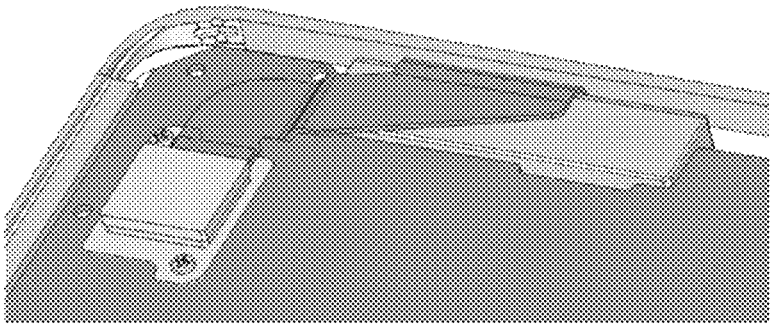
FIG. 7B shows a perspective view of the embodiment of FIG. 7A, wherein the millimeter-wave assembly is mounted into the electronic device.
Figure 8A:
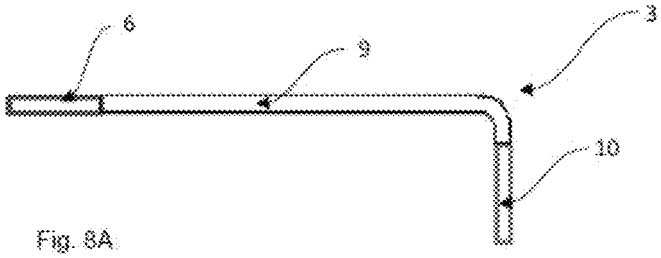
FIG. 8A shows a schematic side view of a millimeter-wave assembly in accordance with one embodiment of the present disclosure.
Figure 8B:
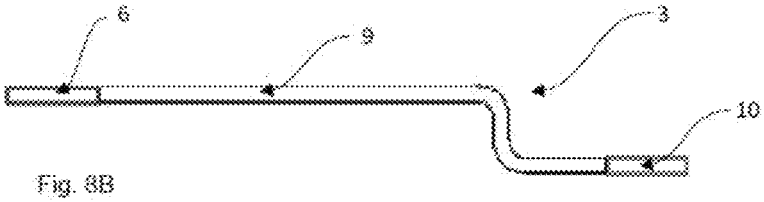
FIG. 8B shows a schematic side view of a millimeter-wave assembly in accordance with a further embodiment of the present disclosure.

The present disclosure further relates to a method of assembling the electronic device 13, which comprises a plurality of sequential or nonsequential steps. As shown in FIG. 7A, the first mmWave module 2 of the mmWave assembly 1 is connected to the device chassis 14. The second mmWave module 3 of the mmWave assembly 1 is connected to the device chassis 14, the housing 15, and/or an electromechanical module 16 arranged between the device chassis 14 and the housing 15, as also shown in FIG. 7A. The first mmWave module 2 engages with the second mmWave module 3, as shown in FIG. 7B, by means of a connector 4. In one embodiment, the second mmWave module 3 of the mmWave assembly 1 is connected to the electromechanical module 16. The electromechanical module 16 may be, e.g., a camera module.

As mentioned above, the millimeter-wave (mmWave) assembly 1 comprises a first mmWave module 2, a second mmWave module 3, and a connector 4 configured to releasably interconnect the first mmWave module 2 and the second mmWave module 3.

The connector 4 comprises at least a first connector element 5 associated with the first mmWave module 2. By "associated" is meant being connected by means of, e.g., screws, adhesive, soldering or the like.

The first mmWave module 2 comprises at least a first substrate 7 and an mmWave RFIC 8. The second mmWave module 3 comprises at least a second substrate 9 and an mmWave antenna array 10. At least one of the first substrate 7 and the second substrate 9 may be a flexible or rigid printed circuit board.

In one embodiment, the first mmWave module 2 comprises a further mmWave antenna array 12. The mmWave antenna array 12 may be arranged such that it generates radiation in the same direction, or in different directions, than the radiation generated by mmWave antenna array 10.

Figure 3:
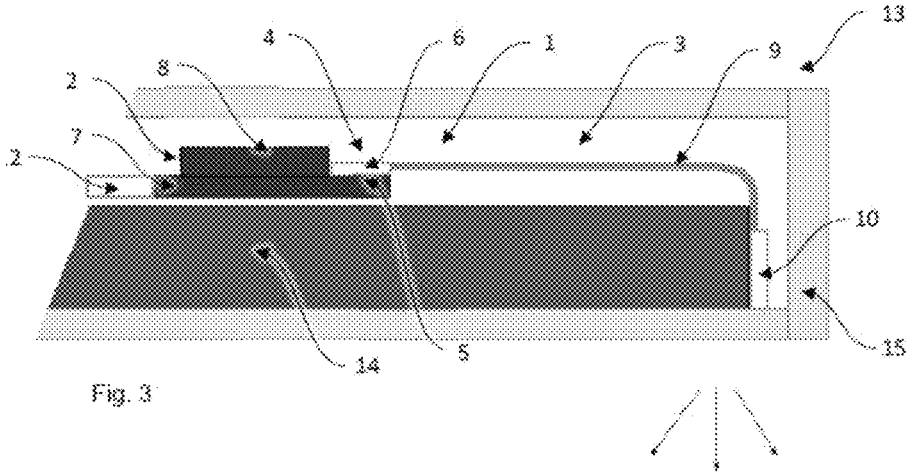
FIG. 3 shows a schematic cross-sectional side view of a millimeter-wave assembly mounted in an electronic device in accordance with yet another embodiment of the present disclosure.
Figure 4:
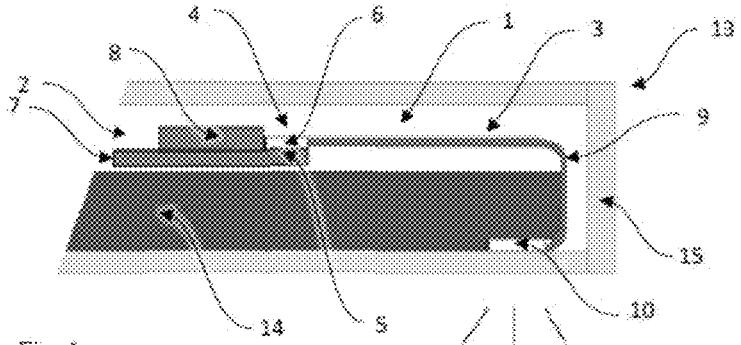
FIG. 4 shows a schematic cross-sectional side view of a millimeter-wave assembly mounted in an electronic device in accordance with yet another embodiment of the present disclosure.

One or both of the mmWave antenna arrays 10, 12 may extend at an angle ≥0° to a main plane of the first substrate. The mmWave antenna array 10 may extend essentially perpendicular, i.e. at 90°, to the main plane of the first substrate 7, as shown in FIGS. 1 to 3 and 5. The mmWave antenna array 10 may extend essentially parallel to the main plane of the first substrate 7, as shown in FIG. 4, showing a 180° angle, and FIG. 6, showing a 0° angle. The mmWave antenna array 12 may extend essentially parallel to the main plane of the first substrate 7, and as shown in FIG. 3, extend in the main plane of the first substrate 7.

Figure 5:
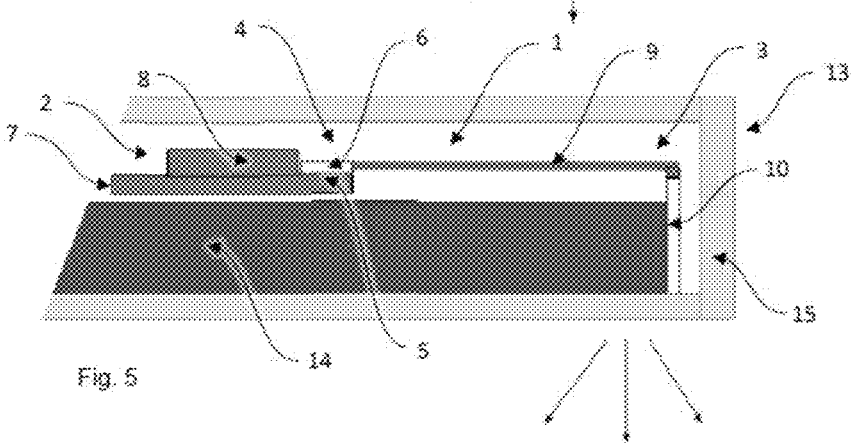
FIG. 5 shows a schematic cross-sectional side view of a millimeter-wave assembly mounted in an electronic device in accordance with yet another embodiment of the present disclosure.
Figure 6:
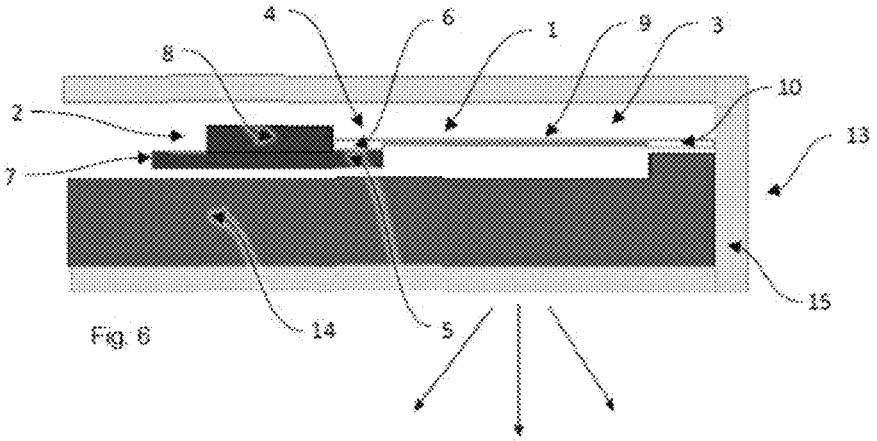
FIG. 6 shows a schematic cross-sectional side view of a millimeter-wave assembly mounted in an electronic device in accordance with yet another embodiment of the present disclosure.

The above-mentioned angle is achieved by means of either a bend in the second substrate 9, as shown in FIGS. 1 to 4, or by means of the second substrate 9 and the mmWave antenna array 10 being split into separate elements, as shown in FIG. 5, with the separate elements being fixedly interconnected by means of, e.g., soldering or being releasably interconnected by means of the galvanic or non-galvanic connections described further below. The angle may also be achieved by means of a plurality of bends, e.g., two 45° bends (not shown).

Each antenna array 10, 12 may be arranged such that one end of the array is located closer to the first substrate 7 than the other end of the array. Furthermore, each antenna array 10, 12 may be arranged such that one end of the array is located closer to the second substrate 9 than the other end of the array. The distance between the respective ends of the array, and the first and/or second substrate, may be seen in any direction, including directions perpendicular to, and parallel with, a main plane of the first substrate 7 and/or the second substrate 9. One or both the mmWave antenna arrays 10, 12 may be offset in at least one direction in relation to the main plane of the first substrate 7 and/or the second substrate 9. As shown in FIGS. 4 and 6, the antenna arrays 10, 12 may extend parallel to the main plane of the first substrate 7, but at a distance from the first substrate 7, such that the antenna array extends between the device chassis 14 and a rear or front section of the housing 15. As shown in FIGS. 1 to 3 and 5, the antenna arrays 10, 12 may extend perpendicular to the main plane of the first substrate 7, but at a distance from the first substrate 7 such that the antenna array extends between the device chassis 14 and a side section of the housing 15. Furthermore, the antenna arrays 10, 12 may extend in a main plane of the second substrate 9, as shown in FIG. 6.

The connector 4 is configured to transmit at least one signal between the mmWave RFIC 8 and the mmWave antenna array 10 when the first mmWave module 2 and the second mmWave module 3 are interconnected. In one embodiment, the mmWave antenna array 10 comprises a plurality of mmWave antennas, and the connector 4 is configured to transmit a signal between the mmWave RFIC 8 and each one of the plurality of mmWave antennas. The mmWave antenna array 12 may also comprise a plurality of mmWave antennas.

As shown in FIGS. 1 to 6, connector 4 comprises at least a first connector element 5 associated with the first mmWave module 2.

Figure 2:
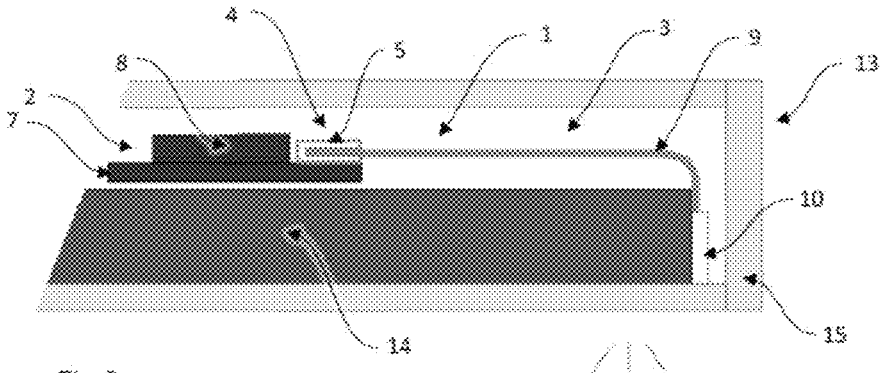
FIG. 2 shows a schematic cross-sectional side view of a millimeter-wave assembly mounted in an electronic device in accordance with a further embodiment of the present disclosure.

In one embodiment, shown in FIG. 2, the first connector element 5 engages directly with the second substrate 9, e.g., by means of a female receptacle soldered to the first substrate 7 and a male counterpart formed within the second substrate 9, such as etched metal pads comprising signal and ground connections.

The connector 4 may further comprise a second connector element 6 associated with the second mmWave module 3, as shown in FIGS. 1 and 3 to 6. The first mmWave module 2 engages with the second mmWave module 3 by means of the first connector element 5 engaging with the second connector element 6. The first connector element 5 may be soldered to the first substrate 7 and the second connector element 6 may be soldered to the second substrate 9. As shown in FIGS. 1 and 3 to 6, the first connector element 5 may engage directly with the second connector element 6.

Figure 9:
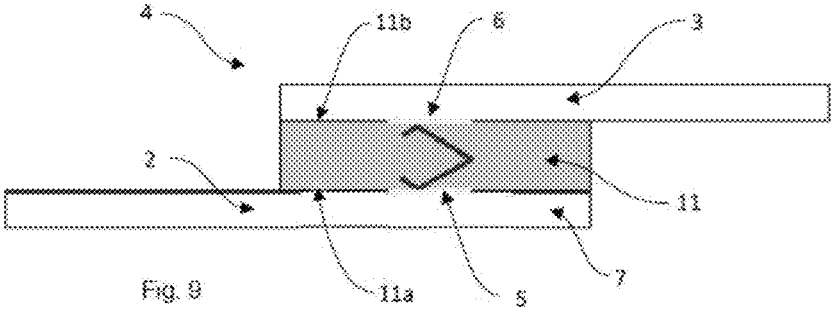
FIG. 9 shows a schematic side view of a section of a millimeter-wave assembly in accordance with yet another embodiment of the present disclosure.

In one embodiment, shown in FIG. 9, the first mmWave module 2 engages with the second mmWave module 3 by means of a third connector element 11, with the first connector element 5 and the second connector element 6 engaging through the third connector element 11. In one embodiment, the third connector element 11 is sandwiched between the first connector element 5 and the second connector element 6. Preferably, the third connector element 11 comprises a first section 11*a* and a second section 11*b*, with the first section 11*a* engaging the first connector element 5 and the second section 11*b* engaging the second connector element 6.

The connector 4 may transmit the signal(s) by means of engagement between the first connector element 5 and the second substrate 9, as shown in FIG. 2. The connector 4 may transmit the signal(s) by means of engagement between the first connector element 5 and the second connector element 6, as shown in FIGS. 1 and 3 to 6. Furthermore, the connector 4 may transmit the signal(s) by means of engagement between the first section 11*a* of the third connector element 11 and the first connector element 5, and/or the second section 11*b* of the third connector element 11 and the second connector element 6, as shown in FIG. 9. The first section 11*a* and/or the second section 11*b* may comprise galvanic connecting members.

In one embodiment, the direct engagement comprises a galvanic connection provided by means of e.g., a zero insertion force (ZIF) connector, a coaxial connector, and/or a combination of connections. The ZIF connector may comprise of one or several coplanar structures. The coplanar structure(s) may be implemented by other means than ZIF such as mating springs integrated within a board-to-board connector.

In a further embodiment, the engagement comprises a non-galvanic connection provided by means of inductive or capacitive near field coupling between at least two of the first connector element 5, the second connector element 6, and the third connector element 11. The two connected elements should be arranged at a maximum distance of 1/10 of the operating wavelength of the antenna array 10, 12.

In one embodiment, at least one of the first connector element 5, the second connector element 6, or the third connector element 11 comprise a spring structure.

The various aspects and implementations have been described in conjunction with various embodiments herein. However, other variations to the disclosed embodiments can be understood and effected by those skilled in the art in practicing the claimed subject-matter, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The reference signs used in the claims shall not be construed as limiting the scope.

The invention claimed is:

1. A mobile electronic device comprising:

a device chassis;

a camera module;

a millimeter-wave (mmWave) assembly comprising:

a first mmWave circuit connected to the device chassis, wherein the first mmWave circuit comprises an mmWave radio-frequency integrated circuit (RFIC), a second mmWave circuit comprising a second mmWave antenna array, and a connector configured to releasably interconnect the first mmWave circuit and the second mmWave circuit; and a housing enclosing the device chassis, the camera, and the mmWave assembly, wherein the second mmWave antenna array and the camera module are located at a same area of the housing.

2. The mobile electronic device according to claim 1, wherein the second mmWave antenna array comprises at least one mmWave antenna, and wherein the connector is configured to transmit at least one signal between the first mmWave circuit and the at least one mmWave antenna.

3. The mobile electronic device according to claim 1, wherein the first mmWave circuit comprises a first substrate including a rigid printed circuit board, and wherein the second mmWave circuit comprises a second substrate including a flexible circuit board.

4. The mobile electronic device according to claim 1, wherein the connector comprises a first connector element associated with the first mmWave circuit, a second connector element associated with the second mmWave circuit, and a third connector element, and wherein the first connector element and the second connector element are configured to engage one another through the third connector element.

5. The mobile electronic device according to claim 4, wherein the third connector element comprises a first section and a second section, wherein the first section is configured to engage the first connector element, and wherein the second section is configured to engage the second connector element.

6. The mobile electronic device according to claim 5, wherein the connector is configured to transmit at least one signal via engagement between at least one of:

the first connector element and a second substrate in the second mmWave circuit;

the first connector element and the second connector element;

the first section and the first connector element; or the second section and the second connector element.

7. The mobile electronic device according to claim 6, wherein the engagement comprises a galvanic connection.

8. The mobile electronic device according to claim 6, wherein the engagement comprises a non-galvanic connection by inductive or capacitive near-field coupling.

9. The mobile electronic device according to claim 1, wherein the first mmWave circuit comprises a first mmWave antenna array, and wherein the first mmWave antenna array comprises at least one mmWave antenna.

10. A method of assembling a mobile electronic device having a device chassis, a camera, and a millimeter-wave (mmWave) assembly, the method comprising:

connecting a first mmWave circuit and a second mmWave circuit of the mmWave assembly to the device chassis, wherein the first mmWave circuit comprises an mmWave radio-frequency integrated circuit (RFIC), and wherein the second mmWave circuit comprises a second mmWave antenna array;

connecting the camera module to the mmWave assembly;

enclosing the device chassis, the camera module, and the mmWave assembly in a housing of the mobile electronic device such that the second mmWave antenna array and the camera are located at a same area of the housing; and engaging the mmWave assembly with a connector configured to releasably interconnect the first mmWave circuit and the second mmWave circuit.

11. The method according to claim 10, wherein the second mmWave antenna array comprises at least one mmWave antenna.

12. The method according to claim 11, wherein the connector is configured to transmit at least one signal between the first mmWave circuit and the at least one mmWave antenna.

13. The method according to claim 10, wherein the first mmWave circuit comprises a first mmWave antenna array.

14. The method according to claim 13, wherein said first mmWave antenna array comprises at least one mmWave antenna.

15. The method according to claim 10, wherein the connector comprises a first connector element associated with the first mmWave circuit.

16. The method according to claim 15, wherein the connector further comprises a second connector element associated with the second mmWave circuit.

17. The method according to claim 16, wherein the connector further comprises a third connector element, and wherein the first connector element and the second connector element are configured to engage one another through the third connector element.

18. The method according to claim 17, wherein the third connector element comprises a first section and a second section.

19. The method according to claim 18, wherein the first section is configured to engage the first connector element.

20. The method according to claim 19, wherein the second section is configured to engage the second connector element.

* * * * *